US006513467B2

(12) United States Patent
Nohara et al.

(10) Patent No.: US 6,513,467 B2
(45) Date of Patent: Feb. 4, 2003

(54) VARIABLE VALVE CONTROL DEVICE OF INTERNAL COMBUSTION ENGINE

(75) Inventors: Tsuneyasu Nohara, Kanagawa (JP); Takanobu Sugiyama, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/934,588

(22) Filed: Aug. 23, 2001

(65) Prior Publication Data

US 2002/0023604 A1 Feb. 28, 2002

(30) Foreign Application Priority Data

Aug. 31, 2000 (JP) ..... 2000-262109

(51) Int. Cl.[7] ..... F01L 1/34

(52) U.S. Cl. ..... 123/90.15; 123/90.16; 123/90.17; 74/568 R

(58) Field of Search ..... 123/90.15, 90.16, 123/90.17; 74/568 R

(56) References Cited

U.S. PATENT DOCUMENTS 6,058,897 A * 5/2000 Nakayoshi ..... 123/90.17

OTHER PUBLICATIONS

U.S. patent application Ser. No. 09/873,399, Shinichi Takemura et al., filed Jun. 5, 2001.

Instruction manual of Toyota car (Altezza) issued on Oct. 1998, from Toyota Jidosha Kabushiki Kaisha, pp. 1–6–1–7; 1–16–1–17; 1–20–1–25.

* cited by examiner

*Primary Examiner*—Thomas Denion
*Assistant Examiner*—Jaime Corrigan
(74) *Attorney, Agent, or Firm*—Foley & Lardner

(57) ABSTRACT

Disclosed is a control device comprising an IVWAV or EVWAV mechanism. The IVWAV mechanism varies a working angle of an intake valve and the EVWAV varies a working angle of an exhaust valve. An IVOPV mechanism varies an operation phase of the intake valve. An EVOPV mechanism varies an operation phase of the exhaust valve, and a control unit controls the IVWAV or EVWAV mechanism and the IVOPV and EVOPV mechanisms according to an operating condition of an engine. The control unit is configured to control the IVWAV or EVWAV mechanism and the IVOPV and EVOPV mechanisms.

15 Claims, 9 Drawing Sheets

VARIABLE VALVE CONTROL DEVICE OF INTERNAL COMBUSTION ENGINE

BACKGROUND OF INVENTION

1. Field of Invention

The present invention relates in general to a control device for controlling an internal combustion engine, and more particularly to a variable valve control device of an internal combustion engines, which comprises a working angle varying mechanism for varying a working angle of the intake or exhaust valve and an operation phase varying mechanism for varying an operation phase of the intake or exhaust valve.

2. Description of Related Art

Hitherto, various types of variable valve control devices have been proposed and put into practical use in the field of automotive internal combustion engines. One of such devices is shown in an instruction manual of Toyota car (ALTEZZA) issued on October, 1998 from Toyata Jidosha Kabushiki Kaisha, which comprises generally a so-called intake valve operation phase varying mechanism which varies the operation phase of each intake valve by changing a relative angular position between an intake valve cam shaft and a cam pulley synchronously rotated with the engine crankshaft, and a so-called exhaust valve operation phase varying mechanism which varies the operation phase of each exhaust valve by changing a relative angular position between an exhaust valve cam shaft and the above-mentioned cam pulley. The intake and exhaust valve operation phase varying mechanisms are both powered commonly by a hydraulic pressure produced by an oil pump driven by the engine crankshaft.

It is now to be noted that the term "operation phase" used in the description corresponds to the operation timing of the corresponding intake or exhaust valve with respect to that of the engine crankshaft, and the term "working angle" used in the description corresponds to the open period of the corresponding intake or exhaust valve and is represented by an angle range (viz., crank angle) of the engine crankshaft.

SUMMARY OF THE INVENTION

In general, when, in a middle-load operation range of the engine, a certain valve overlap is provided at or near the top dead center (TDC) on the intake stroke, a certain amount of internal EGR is obtained, which induces reduction in pumping loss and improvement in fuel consumption and exhaust performance. Furthermore, when, in the middle-load operation range, a certain minus valve overlap is provided, a certain amount of exhaust gas is confined in the combustion chamber, which induces reduction in pumping loss and improvement in fuel consumption. It is to be noted that the valve overlap is a phenomenon wherein both the intake and exhaust valves show their open condition simultaneously for a certain time, and the minus valve overlap is a phenomenon wherein both the intake and exhaust valves show their closed condition simultaneously for a certain time.

While, in a very low load operation range, such as in the operation range at the time of engine idling, it is necessary to remove or at least minimize the valve overlap and/or minus valve overlap in order to suppress unstable combustion caused by the residual gas of the internal EGR. Accordingly, in case of shifting from the middle-load operation range to the very low-load operation range, such as, in case of rapid deceleration of the engine speed, speedy reduction or cancellation of the valve overlap or minus valve overlap is needed.

Accordingly, an object of the present invention is to provide an intake valve control device of an internal combustion engine, which comprises operation phase varying mechanisms for varying an operation phase of the intake and exhaust valves respectively and a working angle varying mechanism for varying a working angle of the intake or exhaust valve, so that in case of engine operation change from a middle-load operation range to a very low-load operation range, reduction or cancellation of the valve overlap and/or minus valve overlap is assuredly and speedily carried out.

In order to embody the present invention, the following facts have been seriously considered by the applicants.

In a working angle varying mechanism, the biasing force of each valve spring affects to operation of the mechanism. That is, the opening action of the valve is carried out against the biasing force of the valve spring and the closing action of the valve is carried out with the aid of the biasing force. This means that in case of reducing the working angle of the valve, the work of the mechanism is assisted by the biasing force of the valve spring. Thus, under the same hydraulic power applied to the mechanism, responsiveness in such working angle reducing case is higher than that in case of increasing the working angle.

While, in an operation phase varying mechanism, a torque is applied to a drive shaft or cam shaft which drives the valve to open and close the same. This means that in case of retarding the operation phase, the work of the mechanism is assisted by the torque. Thus, under the same hydraulic power applied to the mechanism, responsiveness in such operation phase retarding case is higher than that in case of advancing the operation phase.

That is, the degree of the responsiveness is represented by the following order.

Slow: Increasing a working angle by using the working angle varying mechanism.

Slightly fast: Advancing an operation phase by using the operation phase varying mechanism.

Fast: Retarding an operation phase by using the operation phase varying mechanism.

Very fast: Reducing a working angle by using the working angle varying mechanism.

Taking these facts into consideration, the present invention provides a variable valve control device of an internal combustion engine, which, in case of the shifting from the middle-load operation range to the very low-load operation range, selectively operates the operation phase and working angle varying mechanisms in a manner to effectively and speedily reduce or cancel the valve overlap or minus valve overlap.

According to a first aspect of the present invention, there is provided a variable valve control device of an internal combustion engine having intake and exhaust valves. The control device comprises an IVWAV mechanism which varies a working angle of the intake valve; an IVOPV mechanism which varies an operation phase of the intake valve; an EVOPV mechanism which varies an operation phase of the exhaust valve; and a control unit which controls the IVWAV, IVOPV and EVOPV mechanisms in accordance with an operation condition of the engine, the control unit being configured to carry out controlling, in a middle-load operation range of the engine, the IVWAV, IVOPV and EVOPV mechanisms to achieve a valve overlap wherein near the top dead center (TDC) on the intake stroke, there is a certain period when both the intake and exhaust valves assume their open conditions, and in case of shifting of the engine from the middle-load operation range to a very low-load operation range, controlling the IVWAV mechanism to reduce the working angle of the intake valve thereby to retard the open timing of the intake valve and controlling the EVOPV mechanism to advance the operation phase of the exhaust valve thereby to advance the close timing of the exhaust valve.

According to a second aspect of the present invention, there is provided a variable valve control device of an internal combustion engine having intake and exhaust valves. The control device comprises an IVWAV mechanism which varies a working angle of the intake valve; an IVOPV mechanism which varies an operation phase of the intake valve; an EVOPV mechanism which varies an operation phase of the exhaust valve; and a control unit which controls the IVWAV, IVOPV and EVOPV mechanisms in accordance with an operation condition of the engine, the control unit being configured to carry out controlling, in a middle-load operation range of the engine, the IVWAV, IVOPV and EVOPV mechanisms to achieve a minus valve overlap wherein near the top dead center on the intake stroke, there is a certain period when both the intake and exhaust valves assume their close conditions; and in case of shifting of the engine from the middle-load operation range to a very low-load operation range, controlling the IVOPV mechanism to advance the operation phase of the intake valve thereby to advance the open timing of the intake valve and controlling the EVOPV mechanism to retard the operation phase of the exhaust valve thereby to retard the close timing of the exhaust valve.

According to a third aspect of the present invention, there is provided a variable valve control device of an internal combustion engine having intake and exhaust valves. The control device comprises an IVOPV mechanism which varies an operation phase of the intake valve; an EVWAV mechanism which varies a working angle of the exhaust valve; an EVOPV mechanism which varies an operation phase of the exhaust valve; a control unit which controls the IVOPV, EVWAV and EVOPV mechanisms in accordance with an operation condition of the engine, the control unit being configured to carry out controlling, in a middle-load operation range of the engine, the IVOPV, EVWAV and EVOPV mechanisms to achieve a minus valve overlap wherein near the top dead center on the intake stroke, there is a certain period when both the intake and exhaust valves assume their close conditions; and in case of shifting of the engine from the middle-load operation range to a very low-load operation range, controlling the IVOPV mechanism to advance the operation phase of the intake valve thereby to advance the open timing of the intake valve and controlling the EVOPV mechanism to retard the operation phase of the exhaust valve thereby to retard the close timing of the exhaust valve.

According to a fourth embodiment of the present invention, there is provided a variable valve control device of an internal combustion engine having intake and exhaust valves. The control device comprises at least one of IVWAV and EVWAV mechanisms, the IVWAV mechanism functioning to vary a working angle of the intake valve and the EVWAV mechanism functioning to vary a working angle of the exhaust valve; an IVOPV mechanism which varies an operation phase of the intake valve; an EVOPV mechanism which varies an operation phase of the exhaust valve; and a control unit which controls the selected one of the IVWAV and EVWAV mechanisms and the IVOPV and EVOPV mechanisms in accordance with an operation condition of the engine, the control unit being configured to carry out controlling, in a middle-loaded operation range of the engine, the selected one of the IVWAV and EVWAV mechanisms and the IVOPV and EVOPV mechanisms to achieve a valve overlap or a minus valve overlap near the top dead center (TDC) on the intake stroke, and in case of shifting of the engine from the middle-load operation range to a very low-load operation range, controlling the IVWAV mechanism or the IVOPV mechanism to shift the open timing of the intake valve toward the top dead center (TDC) on the intake stroke, and controlling the EVWAV mechanism or EVOPV mechanism to shift the close timing of the exhaust valve toward the top dead center (TDC) on the intake stroke.

DETAILED DESCRIPTION OF EMBODIMENTS

In the following, a variable valve control device of the present invention will be described in detail with reference to the accompanying drawings. For ease of understanding, various directional terms such as, right, left, upper, lower, rightward, etc., are used in the description. However, such terms are to be understood with respect to only a drawing or drawings on which the corresponding element or part is illustrated.

As will become apparent as the description proceeds, the variable valve control device of the invention is so explained as to be applied to an internal combustion engine having cylinders each having two intake valves and two exhaust valves. For simplification of explanation, the following description is made with respect to only a part of the variable valve control device, which is associated with one of the cylinders of the engine.

Figure 1:
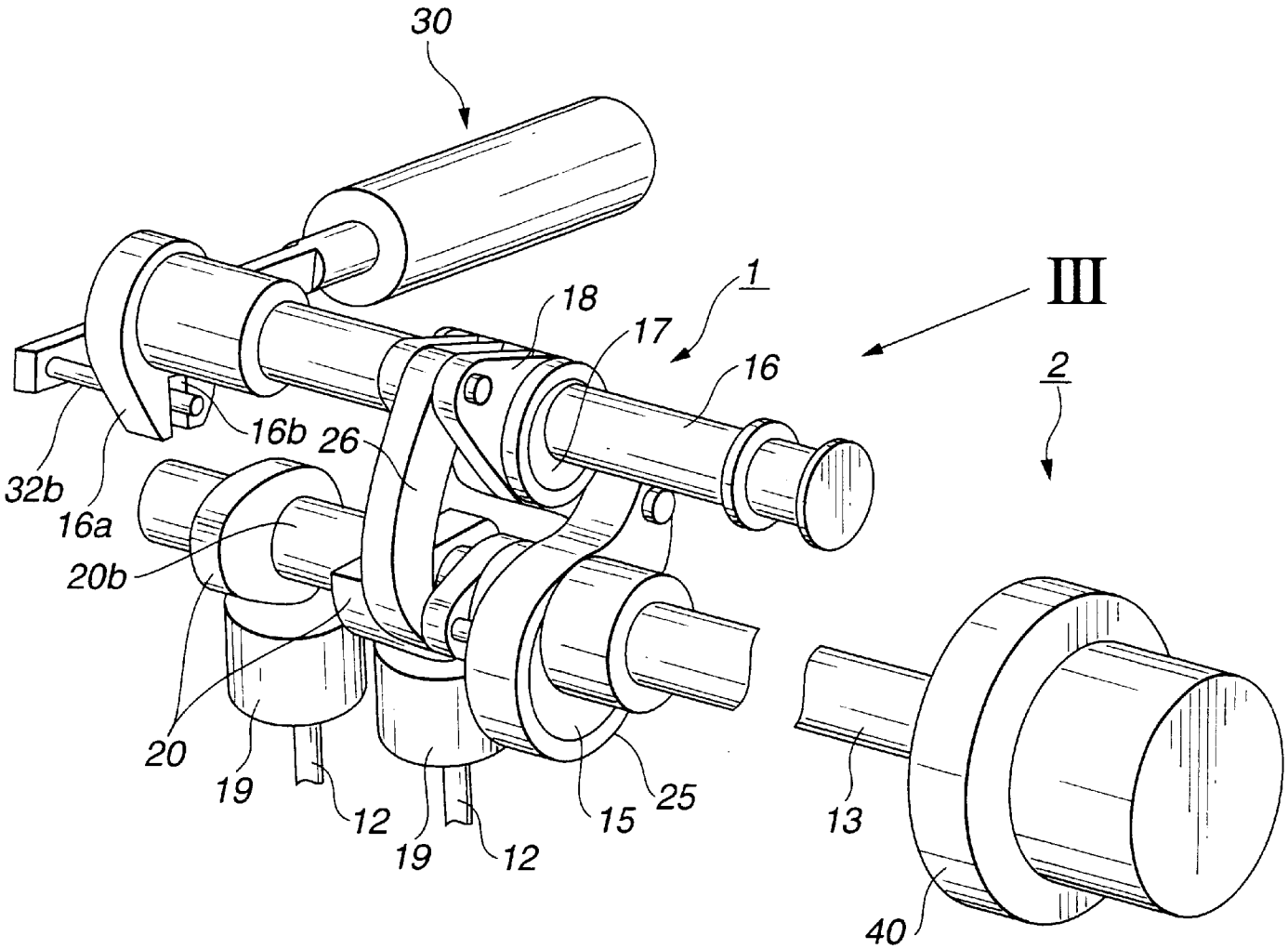
FIG. 1 is a perspective view of a variable valve control device of an internal combustion engine, which embodies the present invention.
Figure 2:
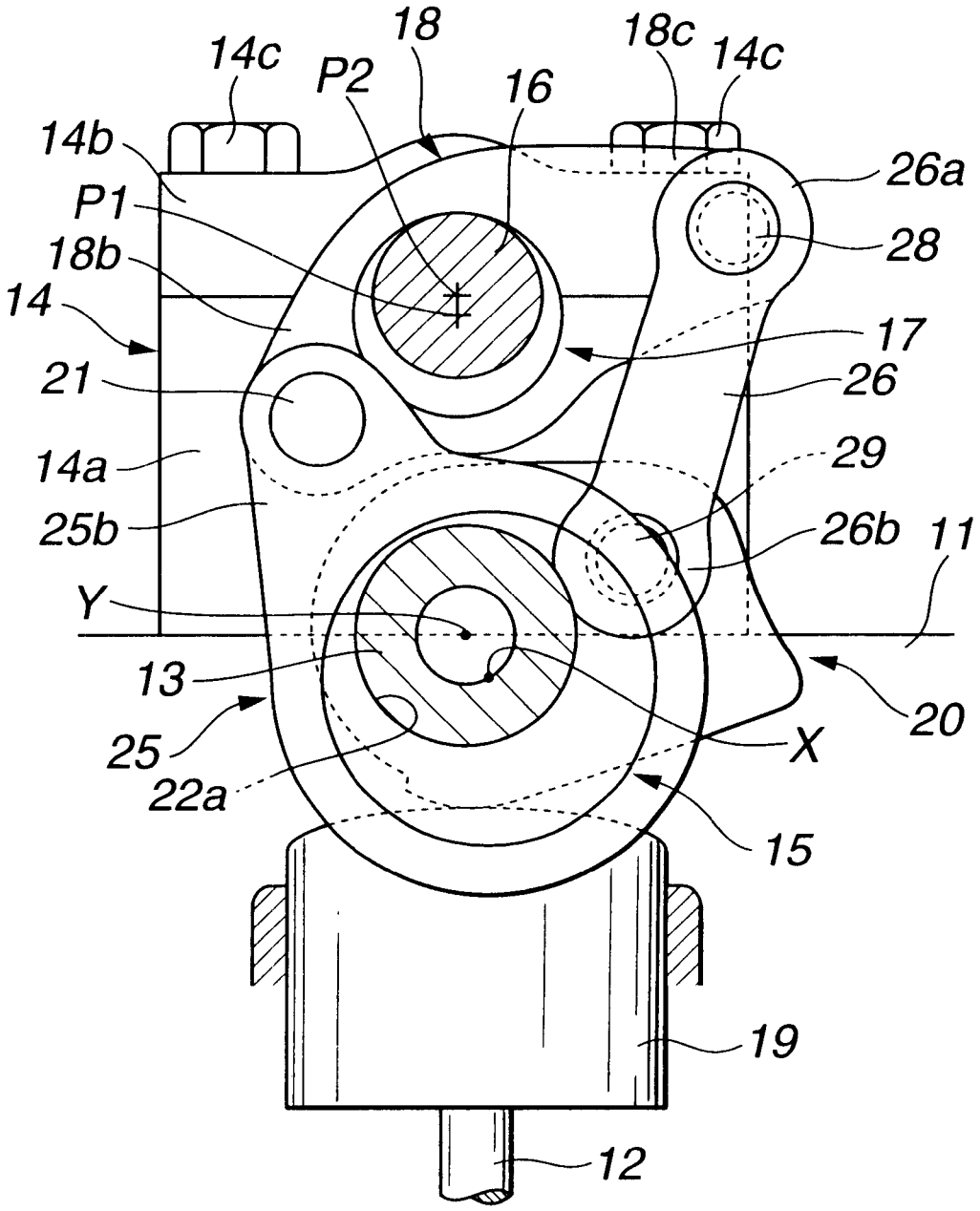
FIG. 2 is a sectional view of the variable valve control device of the invention, showing a part where a working angle varying mechanism is arranged.
Figure 3:
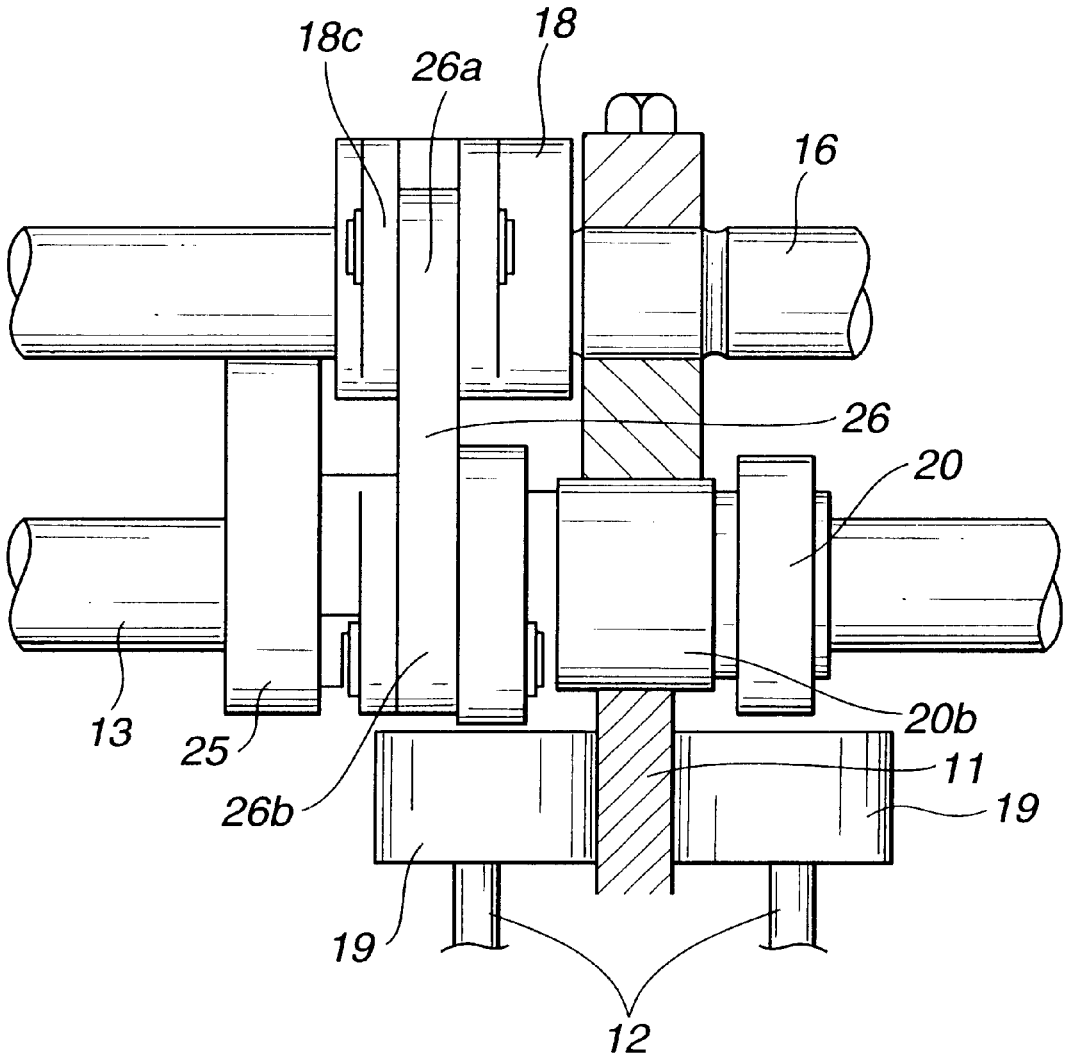
FIG. 3 is a schematic view of the working angle varying mechanism, which is taken from the direction of an arrow "III" of FIG. 1.

Referring to FIGS. 1 to 3, particularly FIG. 1, there is shown one unit (which will be referred to "internal valve control device" hereinafter) of the variable valve control device of an internal combustion engine, which is applied to the intake valves of the engine.

It is to be noted that substantially same unit (which will be referred to "exhaust valve control device" hereinafter) is provided by the control device, which is applied to the exhaust valves of the engine.

As is seen from FIG. 1, the intake valve control device generally comprises a working angle varying mechanism 1 which varies a working angle of a pair of intake valves 12 of each cylinder, and an operation phase varying mechanism 2 which varies the operation phase of intake valves 12.

As will described in detail in the following, in the working angle varying mechanism 1, there is arranged a link mechanism by which a drive shaft 13 driven by a crankshaft (not shown) of an associated internal combustion engine through operation phase varying mechanism 2 and two swing cams 20 actuating valve lifters 19 of intake valves 12 to make open/close movement of intake valves 12 against valve springs (not shown) are mechanically linked to continuously vary the working angle (and the valve lift degree) of intake valves 12 while keeping the center point of the working angle constant. It is to be noted that drive shaft 13 extends in a direction along which the cylinders of the engine are aligned.

That is, the working angle varying mechanism 1 comprises an eccentric cam 15 eccentrically fixed to drive shaft 13, a ring-like link 25 rotatably disposed on eccentric cam 15, a control shaft 16 extending in parallel with drive shaft 13, a control cam 17 eccentrically fixed to control shaft 16, a rocker arm 18 rotatably disposed on control cam 17 and having one end 18*b* (see FIG. 2) pivotally connected through a connecting pin 21 to a leading end 25*b* of ring-like link 25, and a rod-like link 26 by which the other end 18*c* of rocker arm 18 and one of swing cams 20 are linked.

As is seen from FIG. 2, the center "X" of eccentric cam 15 is displaced from the center "Y" of drive shaft 13 by a predetermined degree, and the center "P1" of control cam 17 is displaced from the center "P2" of control shaft 16 by a predetermined degree. As is seen from FIGS. 2 and 3, a journal portion 20*b* of swing cam 20, which is rotatably disposed about drive shaft 13, and a journal portion of control shaft 16 are rotatably held by a pair of brackets 14*a* and 14*b* which are secured to a cylinder head 11 of the engine through common bolts 14*c*.

As is seen from FIG. 1, the rod-like link 26 is arranged to extend generally along an axis of the corresponding intake valve 12. As is seen from FIG. 2, one end 26*a* of rod-like link 26 is pivotally connected to the other end 18*c* of rocker arm 18 through a connecting pin 28.

When, with the above-mentioned arrangement, the drive shaft 13 is rotated due to rotation of crankshaft, the ring-like link 25 is forced to make a translation motion through eccentric cam 15, and thus the swing cam 20 is forced to swing through rocker arm 18 and rod-like link 26 resulting in that the intake valves 12 are forced to make open/close movement against force of the valve springs (not shown).

While, when the control shaft 16 is rotated within a given angular range by an after-mentioned actuator 30, the center "P1" of control cam 17, which serves as a rotation center of rocker arm 18, is forced to move about the center "P2" of control shaft 16. With this movement, a link unit including ring-like link 25, rocker arm 18 and rod-like link 26 is forced to change its posture and thus the working angle and valve lift degree of intake valves 12 are continuously varied keeping the operation phase of the same constant.

In the above-mentioned working angle varying mechanism 1, the swing cam 20 which actuates intake valve 12 is rotatably disposed about drive shaft 13 which is rotated along with the crankshaft of the engine. Accordingly, undesired center displacement of swing cam 20 relative to drive shaft 13 is suppressed, and thus, controllability is improved. Since the swing cam 20 is supported by drive shaft 13, there is no need of providing a separate supporting shaft for swing cam 20. Thus, advantages are expected in view of the number of parts used and the mounting space. Furthermore, since the connecting portions of the parts are made through a so-called surface to surface contact, adequate abrasion resistance is obtained.

Figure 4:
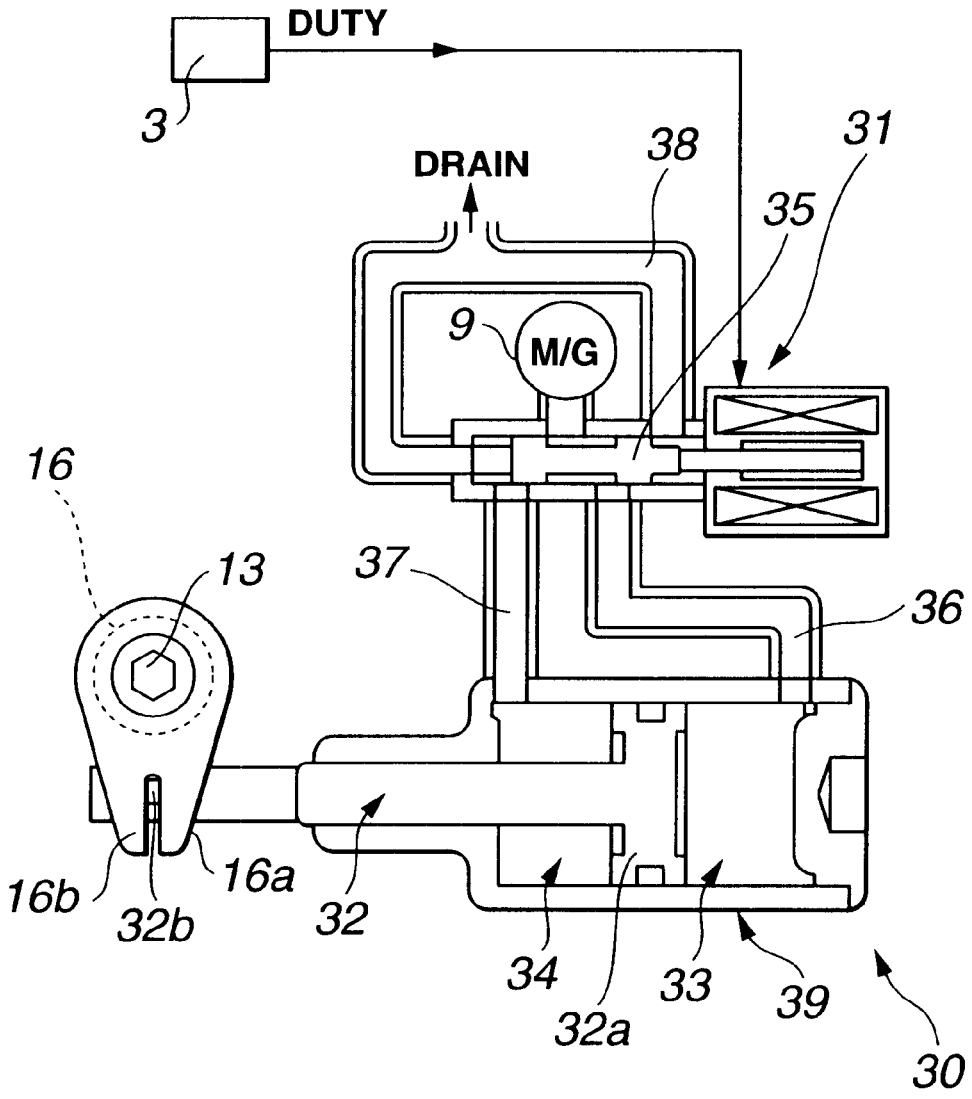
FIG. 4 is a diagram showing a hydraulic actuator and a solenoid valve which are used for controlling a control shaft of the working angle varying mechanism.

Referring to FIG. 4, there is shown the actuator 30 which rotates control shaft 16 within a predetermined angular range. The actuator 30 comprises a cylinder 39 of which interior is divided into first and second hydraulic chambers 33 and 34 due to provision of a piston proper part 32*a* of a piston 32. Thus, in accordance with a pressure difference appearing between the first and second hydraulic chambers 33 and 34, the piston 32 is forced to move in a fore-and-aft direction. A stem portion of piston 32 has a leading end exposed to the open air. The leading end of the piston stem has a pin 32*b* fixed thereto. As shown, the piston stem extends perpendicular to an axis of control shaft 16. A link plate 16*a* is fixed to one end of control shaft 16 to rotate therewith about the axis of control shaft 16. The link plate 16*a* is formed with a radially extending slot 16*b* with which the pin 32*b* of the piston stem is slidably engaged. Accordingly, upon the fore-and-aft movement of piston 32, the control shaft 16 is rotated within a predetermined angular range about its axis.

Oil supply to first and second hydraulic chambers 33 and 34 is switched in accordance with the position of a spool 35 of a solenoid valve 31. The solenoid valve 31 is controlled in ON/OFF manner (viz., duty-control) by a control signal issued from an engine control unit 3. The control unit 3 comprises a microcomputer including generally CPU, RAM, ROM and input and output interfaces. That is, by varying the duty ratio of the control signal in accordance with the operation condition of the engine, the position of spool 35 is changed.

That is, when, as shown in the drawing, the spool 35 assumes a rightmost position, a first hydraulic passage 36 connected with first hydraulic chamber 33 is connected with an oil pump 9 thereby feeding first hydraulic chamber 33 with a hydraulic pressure and at the same time, a second hydraulic passage 37 connected with second hydraulic chamber 34 is connected with a drain passage 38 thereby draining the oil from second hydraulic chamber 34. Accordingly, the piston 32 of actuator 30 is shifted leftward in the drawing.

While, when the spool 35 assumes a leftmost position in the drawing, the first hydraulic passage 36 is connected with drain passage 38 to drain the oil from first hydraulic chamber 33, and at the same time, the second hydraulic passage 37 is connected with oil pump 9 to feed second hydraulic chamber 34 with a hydraulic pressure. Thus, the piston 32 is shifted rightward in the drawing.

While, when the spool 35 is in a middle position, both of first and second hydraulic passages 36 and 37 are closed by spool 35, and thus, the hydraulic pressure in first and second hydraulic chambers 33 and 34 is held or locked thereby holding piston 32 in a corresponding middle position.

As is described hereinabove, the piston 32 of actuator 30 is moved to or held at a desired position, and thus, the working angle of intake valves 12 can be controlled to a desired angle within a predetermined angular range.

It is to be noted that the engine control unit 3 controls working angle varying mechanism 1 and operation phase varying mechanism 2 in accordance with an engine speed, an engine load, a temperature of engine cooling water and a vehicle speed. In addition to this control, the engine control unit 3 carries out an ignition timing control, a fuel supply control, a transition correction control and a fail-safe control.

In the following, the operation phase varying mechanism 2 will be described with reference to FIGS. 5 to 9 and FIG. 1.

As will become apparent as the description proceeds, the operation phase varying mechanism 2 functions to vary a relative angular position between drive shaft 13 and a timing pulley 40 that is rotatably disposed on drive shaft 13 and synchronously rotated together with the engine crankshaft, so that the operation phase of intake valves 12 is varied while keeping the working angle and the valve lift degree of intake valves 12 constant.

Figure 5:
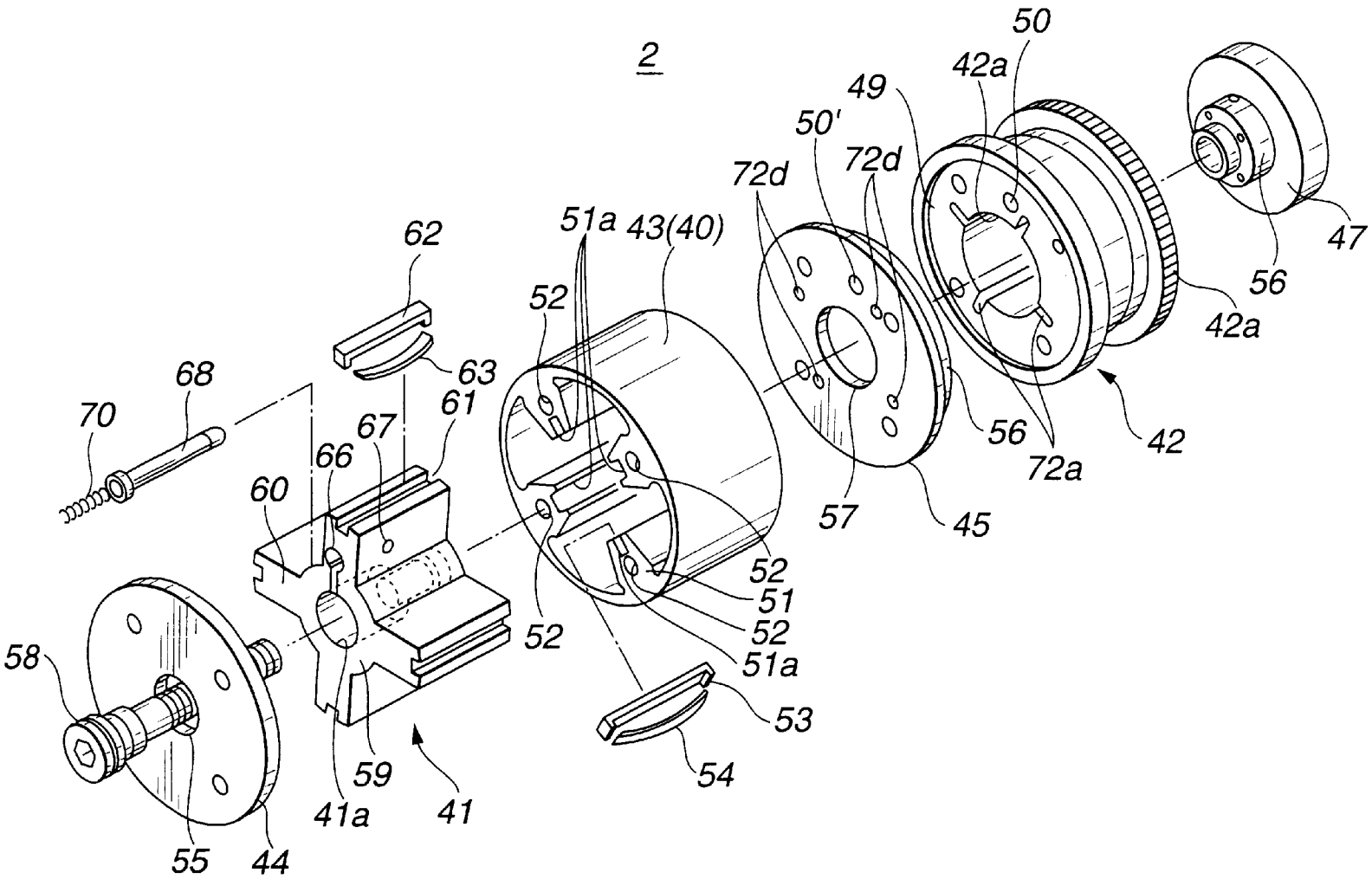
FIG. 5 is an exploded view of an operation phase varying mechanism employed in the variable valve control device of the invention.
Figure 6:
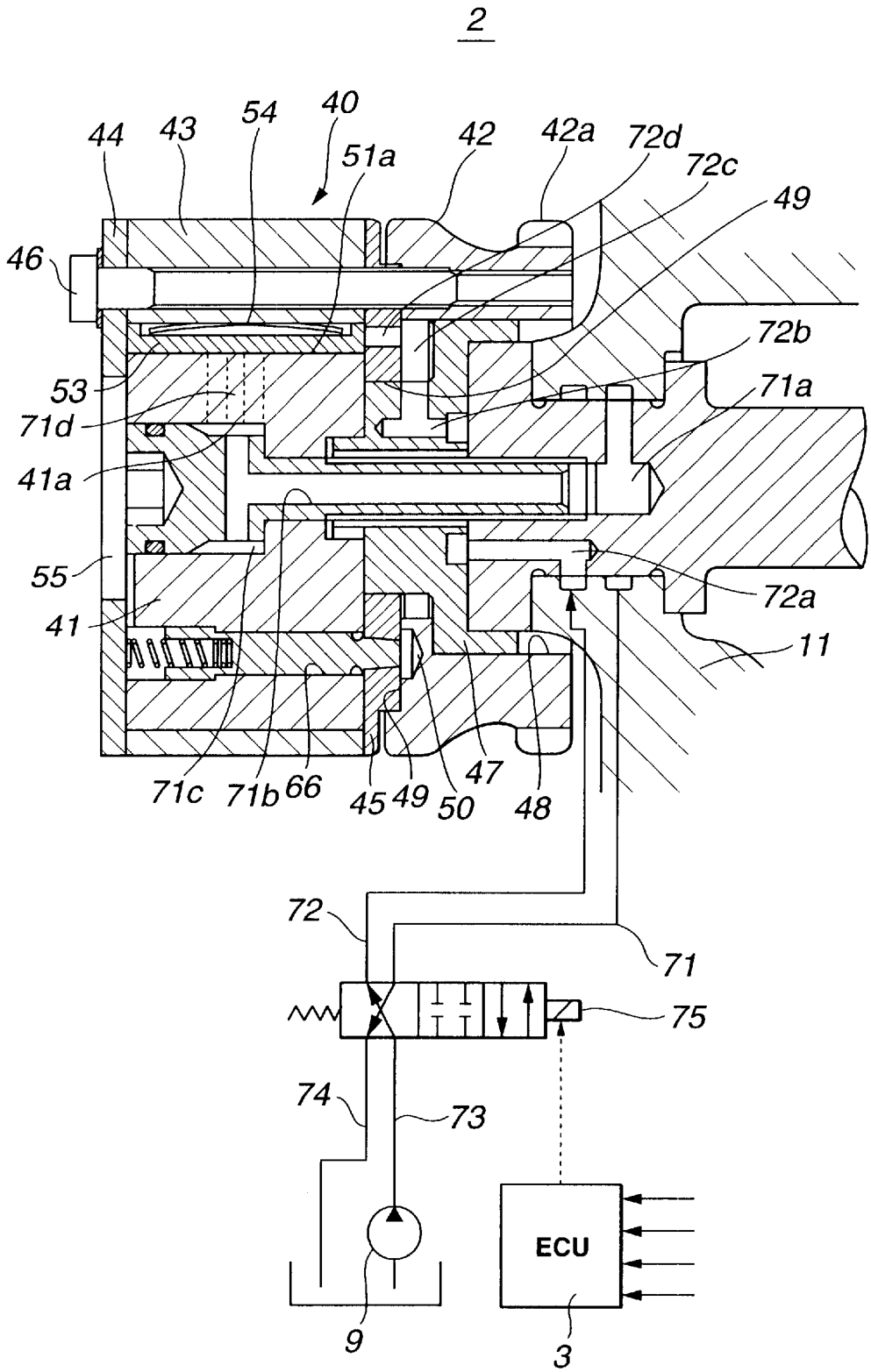
FIG. 6 is a sectional view of the operation phase varying mechanism in an assembled condition.

That is, as is seen from FIGS. 1, 5 and 6, the operation phase varying mechanism 2 comprises generally the timing pulley 40 fixed to an axial end of drive shaft 13, a vane unit 41 rotatably installed in timing pulley 40 and a hydraulic circuit structure arranged to rotate vane unit 41 in both directions by a hydraulic power.

As is seen from FIG. 5, the timing pulley 40 generally. comprises a rotor member 42 which has an external gear 42*a* meshed with teeth of a timing chain (not shown), a cylindrical housing 43 which is arranged in front of rotor member 42 and rotatably disposes therein vane unit 41, a circular front cover 44 which covers a front open end of the housing 43, a circular rear cover 45 which is arranged between housing 43 and rotor member 42 and covers a rear open end of housing 43, and a plurality of bolts 46 (see FIG. 6) which coaxially connects housing 43, front cover 44 and rear cover 45 as a unit.

As is seen from FIGS. 5 and 6, the rotor member 42 is of a cylindrical member and has a center bore 42*a* formed therethrough. The rotor member 42 is formed with a plurality of internally threaded bolt holes (no numerals) with which the threads of bolts 46 are engaged. Furthermore, as is seen from FIG. 6, the center bore 42*a* of rotor member 42 has a diametrically enlarged rear (or right) portion 48 which is mated with an after-mentioned sleeve member 47. Furthermore, the rotor member 42 has at its front (or left) side a coaxial circular recess 49 which has rear cover 45 mated therewith. The rotor member 42 has further an engaging hole 50 at a given portion of circular recess 49.

As is seen from FIG. 5, the cylindrical housing 43 has axial both ends opened and has on its inner surface four axially extending partition ridges 51 which are arranged at equally spaced intervals (viz., 90°). As shown, each partition ridge 51 has a generally trapezoidal cross section and has axial both ends flush with the both ends of cylindrical housing 43. Furthermore, each partition ridge 51 has an axially extending bolt hole 52 through which the corresponding bolt 46 passes. Furthermore, each partition ridge 51 has at its inner top portion an axially extending holding groove 51*a*. As may be seen from FIG. 6, each holding groove 51*a* receives therein an elongate seal member 53 and a plate spring 54 which biases seal member 53 radially inwardly.

As is seen from FIG. 5, the circular front cover 44 is formed with a center opening 55. The front cover 44 further has four bolt holes (no numerals) which are mated with bolt holes 52 of the cylindrical housing 43.

As is seen from FIG. 5, the circular rear cover 45 is formed on its rear side with an annular ridge 56 which is intimately engaged with circular recess 49 of the above-mentioned rotor member 42. Furthermore, the rear cover 45 is formed with a center opening 57 with which a smaller diameter annular portion 56 of sleeve member 47 is engaged. The rear cover 45 has further four bolt holes (no numerals) which are mated with bolt holes 52 of cylindrical housing 43. Furthermore, the rear cover 45 is formed with an engaging hole 50' at a position corresponding to engaging hole 50 of rotor member 42.

As is seen from FIG. 5, the vane unit 41 is made of a sintered alloy and is connected to the front end of drive shaft 13 (see FIG. 1) through a connecting bolt 58. That is, the vane unit 41 is rotated together with drive shaft 13. More specifically, the vane unit 41 comprises a cylindrical base portion 59 which has an axially extending bore 41*a* through which the connecting bolt 58 passes, and four equally spaced and axially extending vane portions 60 which are raised radially outward from base portion 59.

Figure 7:
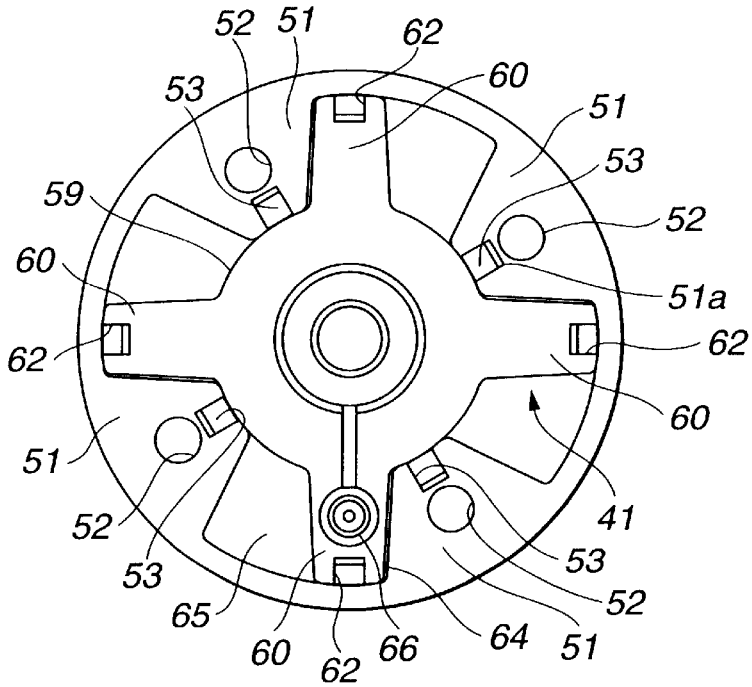
FIG. 7 is a sectional view of an essential portion of the operation phase varying mechanism.

As shown, each vane portion 60 is in the rectangular shape, and as is seen from FIG. 7, each vane portion 60 is put between two adjacent partition ridges 51 of housing 43. Each vane portion 60 has at its outer top portion an axially extending holding groove 61. Each holding groove 61 receives therein an elongate seal member 62 and a plate spring 63 which biases seal member 62 radially outwardly. As shown in FIG. 7, each seal member 53 of cylindrical housing 43 is biased against an outer cylindrical wall of the cylindrical base portion of vane unit 41 to establish a hermetic sealing therebetween, and each seal member 62 of vane unit 41 is biases against an inner cylindrical wall of cylindrical housing 43 to establish a hermetic sealing therebetween.

As is seen from FIG. 7, due to placement of the vane portion 60 of vane unit 41 in each space defined between two adjacent partition ridges 51 of cylindrical housing 43, there are defined an advancing hydraulic chamber 64 and a retarding hydraulic chamber 65 in the space.

As is seen from FIGS. 5 and 7, one of vane portions 60 of the vane unit 41 is formed with an axially extending bore 66 at a position corresponding to the engaging hole 50' of rear cover 45. As is seen from FIG. 5, the vane portion 60 is formed with a small passage 67 for connecting advancing and retarding hydraulic chambers 65 and 66.

As is seen from FIGS. 5 and 6, a lock pin 68 is axially slidably received in the axially extending bore 66 of vane portion 60. As is seen from FIGS. 8 and 9, the lock pin 68 comprises a cylindrical middle portion 68*a*, a smaller diameter engaging portion 68*b* and a larger diameter stopper portion 68*c*.

Figure 8:
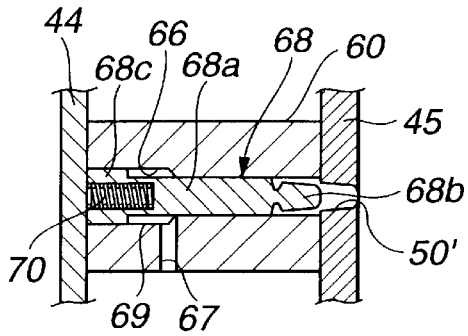
FIG. 8 is a partial view showing an unlocked condition of the operation phase varying mechanism.

As is seen from FIG. 8, for hydraulically actuating lock pin 68 in bore 66 of vane portion 60, there is formed a pressure receiving chamber 69 which is defined by a stepped surface of the larger diameter stopper portion 68*c*, the an outer surface of middle portion 68*a* and a cylindrical inner wall of bore 66. Between the lock pin 68 and the front cover 44, there is compressed a coil spring 70 which biases the lock pin 68 toward the rear cover 45.

Figure 9:
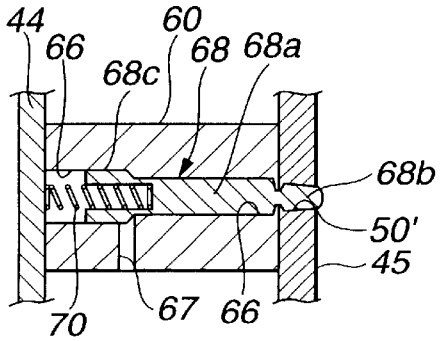
FIG. 9 is a view similar to FIG. 8, but showing a locked condition of the operation phase varying device.

It is to be noted that when the vane unit 41 assumes a most retarded angular position, the engaging portion 68*b* of the lock pin 68 is engaged with the engaging hole 50' of the rear cover 45 as is seen from FIG. 9.

As is seen from FIG. 6, the hydraulic circuit structure comprises a first hydraulic passage 71 through which hydraulic pressure is fed to or discharged from the advancing hydraulic chamber 64 and a second hydraulic passage 72 through which hydraulic pressure is fed to or discharged from the retarding hydraulic chamber 65. These first and second hydraulic passages 71 and 72 are connected to supply and drain passages 73 and 74 through an electromagnetic switch valve 75.

As is seen from FIG. 6, the first hydraulic passage 71 comprises a first passage part 71*a* which is formed in both cylinder head 11 and drive shaft 13, a first oil passage 71*b* which is formed in the connecting bolt 58 and connected to first passage part 71*a*, an oil chamber 71*c* which is defined between an outer cylindrical surface of an enlarged head of the connecting bolt 58 and an inner cylindrical surface of the axially extending bore 41*a* of base portion 59 of vane unit 41 and connected to first oil passage 71*b* and four radially extending branched passages 71*d* which are formed in base portion 59 of vane unit 41 to connect the oil chamber 71*c* with the four advancing hydraulic chambers 64.

While, as is seen from FIG. 6, the second hydraulic passage 72 comprises a second passage part 72*a* which is formed in both cylinder head 11 and drive shaft 13, a second oil passage 72*b* which is formed in sleeve member 57 and connected to second passage part 72*a*, four oil grooves 72*c* formed at an inner surface of center bore 42*a* of rotor member 42 and connected to second oil passage 72*b* and four oil holes 72*d* which are formed in rear cover 45 at equally spaced intervals to connect the four oil grooves 72*c* with four retarding hydraulic chambers 65 respectively.

The electromagnetic switch valve 75 is of a type having four ports and three operation positions. That is, due to movement of a spool installed in valve 75, the first and second hydraulic passages 71 and 72 are selectively connected to and blocked from supply and drain passages 73 and 74. The movement of the spool is controlled (duty-control) by a control signal issued from engine control unit 3.

By processing information signals from a crank angle sensor and an air flow meter, the control unit 3 detects an existing operation condition of the engine. Furthermore, by processing information signals from a crank angle sensor and a cam angle sensor, the control units 3 detects a relative angular position between timing pulley 40 and drive shaft 13.

In an initial condition induced when the engine stops, the spool of valve 75 assumes its rightmost position as shown in FIG. 6. In this condition, the supply passage 73 is connected with second hydraulic passage 72 and at the same time, the drain passage 74 is connected with first hydraulic passage 71. Accordingly, hydraulic pressure in the four retarding hydraulic chambers 65 is kept unchanged, while hydraulic pressure in the four advancing hydraulic chambers 64 is reduced to zero due to connection with drain passage 74. Under this condition, as is seen from FIG. 7, the vane unit 41 assumes a leftmost position or most retarded position wherein each vane portion 60 abuts against a right face of the corresponding left partition ridge 51 of cylindrical housing 43. In this condition, the operation phase of each intake valve 12 is controlled at a retarded side.

In an initial stage of engine starting, the vane unit 41 is held in the most retarded position. When, under this initial stage, the hydraulic pressure in the retarding hydraulic chambers 65 is relatively low in such a degree that the hydraulic pressure fed to pressure receiving chamber 69 through bore 67 is still lower than the force of coil spring 70, the lock pin 68 is kept engaged with engaging hole 50' of the rear cover 45, as is shown in FIG. 9. Accordingly, the vane unit 41 is locked to cylindrical housing 43 keeping the most retarded angular position. Thus, undesired vibration, which would be caused by a varying hydraulic pressure in the retarding hydraulic chambers 64 and a varying torque produced by drive shaft 13, is suppressed or at least minimized. This prevents generation of noises caused by collision of vane portions 60 against partition ridges 51.

When, after passing of a certain time from the engine starting, the hydraulic pressure in retarding hydraulic chamber 65 is increased and at the same time the hydraulic pressure in pressure receiving chamber 69 is increased. Thus, the lock pin 68 is moved back against the force of coil spring 70 and thus finally, as is seen from FIG. 8, the lock pin 68 is disengaged from engaging hole 50' of rear cover 45. Upon this, the locked condition between vane unit 41 and cylindrical housing 43 becomes canceled permitting free rotation of vane unit 41 in the housing 43.

When the spool (see FIG. 6) of the switch valve 75 is moved to its leftmost position in the drawing, the supply passage 73 becomes connected with first hydraulic passage 71 and at the same time the drain passage 74 becomes connected with second hydraulic passage 72. Accordingly, in this condition, hydraulic pressure in the retarding hydraulic chamber 65 is led to the oil pan through second hydraulic passage 72 and drain passage 74, and at the same time, hydraulic pressure from the oil pump 9 is led into advancing hydraulic chamber 64 through supply passage 73 and first hydraulic passage 71. Upon this, the vane unit 41 is turned in a clockwise direction in FIG. 7, that is, in an advancing direction, and thus, the operation phase of each intake valve 12 is shifted to an advanced side.

While, when the spool (see FIG. 6) of switch valve 75 is kept in a middle position, both first and second hydraulic passages 71 and 72 are blocked by the spool. As a result, hydraulic pressure in both first and second hydraulic chambers 33 and 34 of actuator 30 are locked, so that the vane unit 41 assumes a corresponding intermediate position, keeping the operation phase of each intake valve 12 at a corresponding value.

As is described hereinabove, in the operation phase varying mechanism 2, by changing the position of the spool of electromagnetic switch valve 75 in accordance with the operation condition of the engine, the vane unit 41 can be held in a desired intermediate position. That is, according to the operation phase varying mechanism 2, the operation phase of each intake valve 12 can be varied and held in a desired value irrespective of the simple structure possessed by mechanism 2.

As is easily seen from FIG. 1, in the intake valve control device of the invention, the working angle varying mechanism 1 and the operation phase varying mechanism 2 are arranged at different positions without making a relative interference therebetween. Both the mechanisms 1 and 2 are powered by a common oil pump 9, which is one of conditions to simplify the construction of the intake valve control device.

As has been described hereinabove, the exhaust valve control device has substantially the same construction as the above-mentioned intake valve control device. That is, the above description on the intake valve control device can be equally applied to the exhaust valve control device except the type of the valves. That is, in case of the exhaust valve control device, the valves 12 (see FIG. 1) actuated by the swing cams 20 are a pair of exhaust valves of the associated engine.

For ease of understanding, the working angle and operation phase varying mechanisms for the exhaust valves will be denoted by (1) and (2) and the exhaust valves actuated by these mechanisms (1) and (2) will be denoted by (12).

Figure 10A:
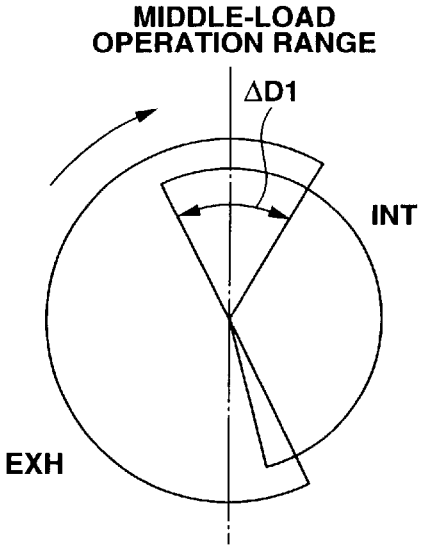
FIGS. 10A and 10B are illustrations showing different conditions of the engine, which are achieved by a first embodiment of the variable valve control device of the invention.
Figure 10B:
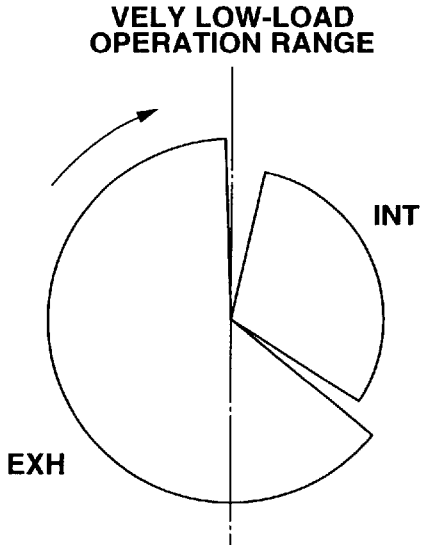

FIGS. 10A and 10B are illustrations schematically showing open/close timing of the intake and exhaust valves, which is provided by a first embodiment of the present invention.

In this first embodiment, controlling of intake valves 12 is carried out by allowing control unit 3 to control both the working angle and operation phase varying mechanisms 1 and 2 for intake valves 12, and controlling of exhaust valves (12) is carried out by allowing control unit 3 to control operation phase varying mechanism (2) for exhaust valves (12).

As shown in FIG. 10A, in a middle-load operation range, the open timing of intake valve 12 is set before the top dead center (TDC) on the intake stroke, and the close timing of exhaust valve (12) is set after the top dead center (TDC) on the intake stroke, so that in the vicinity of the top dead center (TDC) on the intake stroke, there is produced a valve overlap of a degree "ΔD1". With this production, a certain amount of internal EGR gas is obtained inducing reduction in pumping loss and improvement in fuel consumption.

While in a very low-load operation range, such as a range induced when the engine is under idling, such valve overlap is removed for improving the combustion stability.

Accordingly, in case of rapid shifting of the engine from the middle-load operation range to the very low-load operation range, such as, in case of rapid deceleration of the engine speed, speedy reduction or cancellation of the valve overlap is needed.

Thus, in the first embodiment, upon need of this speedy reduction of the valve overlap, the open timing of the intake valve 12 is retarded toward the top dead center (TDC) on the intake stroke and at the same time the close timing of the exhaust valve (12) is advanced toward the top dead center (TDC) on the intake stroke.

For retarding the open timing of intake valve 12, there are two methods, one being a method executed by working angle varying mechanism 1 for intake valves 12, and the other being a method executed by operation phase varying mechanism 2 for intake valves 12. In the method by mechanism 1, the working angle of intake valve 12 is reduced, and in the method by the other mechanism 2, the operation phase of intake valve 12 is retarded.

In case of reducing the working angle of intake valve 12 by working angle varying mechanism 1, the valve spring for intake valve 12 assists the needed work of mechanism 1, and thus, satisfied responsiveness in working angle change is obtained by mechanism 1. Accordingly, upon need of the rapid shifting from the middle-load operation range to the very low-load operation range, the working angle varying mechanism 1 is actuated to reduce the working angle of intake valve 12 while stopping operation of operation phase varying mechanism 2. With this, the open timing of intake valve 12 is speedily retarded.

While, in case of advancing the close timing of exhaust valve (12), the operation phase varying mechanism (2) is actuated. In this mechanism (2), since the cam shaft or the drive shaft (13) is constantly applied with a certain torque, having the operation phase advanced needs a certain hydraulic pressure that overcomes the torque of drive shaft (13). Accordingly, upon need of rapid shifting from the middle-load operation range to the very low-load operation range, the hydraulic pressure is instantly fed to operation phase varying mechanism (2) to instantly and effectively actuate mechanism (2). With this, the close timing of exhaust valve (12) is speedily advanced.

That is, upon need of the above-mentioned rapid shifting, retardation of the open timing of intake valves 12 is effected by the working angle varying mechanism 1 for intake valves 12, and at the same time, advancement of the close timing of exhaust valves (12) is effected by the operation phase varying mechanism (2).

In order to embody such operation, the following measures are employed in the first embodiment, which will be described with reference to FIGS. 4, 6 and 7.

That is, upon need of such rapid shifting, a condition is produced by control unit 3 (see FIGS. 4 and 6) wherein a practical sectional area of a first hydraulic line (see FIGS. 6 and 7) extending from oil pump 9 to the advancing hydraulic chamber 64 of the operation phase varying mechanism (2) is greater than a practical sectional area of a second hydraulic line (see FIG. 4) extending from oil pump 9 to the first or second hydraulic chamber 33 or 34 of working angle varying mechanism 1.

More specifically, upon need of the rapid shifting, the duty ratio of a control signal fed to the electromagnetic switch valve 75 (see FIG. 6) of operation phase varying mechanism (2) is controlled to a highest value (for example 100%) that corresponds to the most advancing degree, and the duty ratio of a control signal fed to solenoid valve 31 (see FIG. 4) of working angle varying mechanism 1 is controlled to an intermediate value that is higher than 0%. However, if desired, the first hydraulic line may be constructed to have a flow resistance that is sufficiently smaller than that of the second hydraulic line.

Figure 11A:
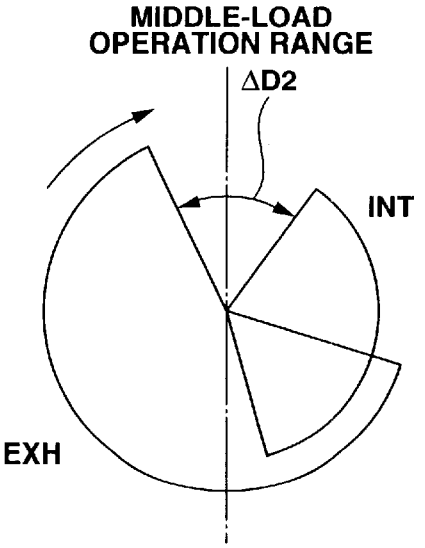
FIGS. 11A and 11B are illustrations similar to FIGS. 10A and 10B, but showing the conditions of the engine, which are achieved by a second embodiment of the invention.
Figure 11B:
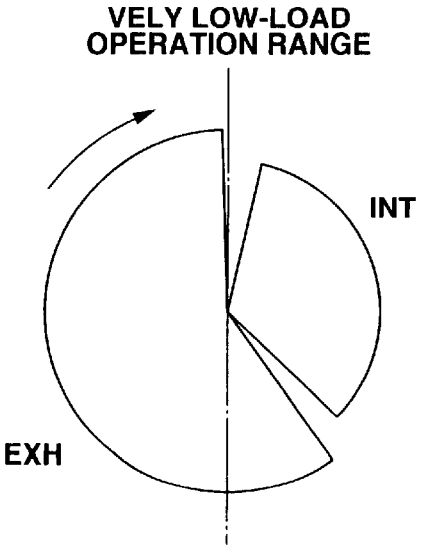

FIGS. 11A and 11B are illustrations schematically showing open/close timing of the intake and exhaust valves 12 and (12), which is provided by a second embodiment of the present invention.

Similar to the above-mentioned first embodiment, in this second embodiment, controlling of intake valves 12 is carried out by allowing control unit 3 to control both working angle and operation phase varying mechanisms 1 and 2 for intake valves 12, and controlling of exhaust valves (12) is carried out by allowing control unit 3 to control only the operation phase varying mechanism (2) for exhaust valves (12).

As shown in FIG. 11A, in a middle-load operation range, the open timing of intake valve 12 is set after the top dead center (TDC) on the intake stroke and the close timing of exhaust valve (12) is set before the top dead center (TDC) on the intake stroke, so that in the vicinity of the top dead center (TDC) on the intake stroke, there is produced a minus valve overlap of a degree "ΔD2". With this production, a certain amount of exhaust gas is left in the cylinder in the vicinity of the top dead center (TDC) on intake stroke, so that reduction of pumping loss and improvement in fuel consumption are achieved.

In case of rapid shifting of the engine from the middle-load operation range to the very low-load operation range, speedy reduction or cancellation of the minus valve overlap is needed in order to assure a stable combustion in the very low-load operation range. That is, if the residual gas is remained in the very low-load operation range, the engine fails to operate stably.

Thus, in the second embodiment, upon need of this speedy reduction of the minus valve overlap, the open timing of intake valve 12 is advanced toward the top dead center (TDC) on the intake stroke and at the same time the close timing of exhaust valve (12) is retarded toward the top dead center (TDC) on the intake stroke.

For advancing the open timing of intake valve 12, there are two methods, one being a method executed by the working angle varying mechanism 1, and the other being a method executed by the operation phase varying mechanism 2. In the method by mechanism 1, the working angle of intake valve 12 is increased and in the method by the other mechanism 2, the operation phase of intake valve 12 is advanced.

In case of increasing the working angle of intake valve 12 by working angle varying mechanism 1, the valve spring for intake valve 12 works to obstruct the needed work of mechanism 1. That is, increasing of the working angle needs a certain hydraulic pressure that overcomes the biasing force of the valve spring. Due to this reason, desired responsiveness in increasing the working angle is not expected.

While, in case of advancing the operation phase of intake valve 12 by using operation phase varying mechanism 2, there is a need of a hydraulic pressure that overcomes the torque applied to drive shaft 13. However, since, in the middle-load operation range, the working angle is relatively small, the torque of drive shaft 13 is accordingly small, and thus, the hydraulic pressure needed for actuating the mechanism 2 to advance the operation phase of intake valve 12 is controlled to a relatively small value.

That is, under an even energy, that is, under the even hydraulic pressure produced by the oil pump 9, the operation phase varying mechanism 2 can exhibit a higher responsiveness in advancing the open timing of intake valve 12 than the working angle varying mechanism 1. Accordingly, upon need of the rapid shifting from the middle-load operation range to the very low-load operation range, the operation phase varying mechanism 2 is actuated to advance the operation phase of intake valve 12 while stopping operation of the working angle varying mechanism 1. With this, the open timing of intake valve 12 is speedily advanced.

While, in case of retarding the close timing of exhaust valve (12), the operation phase varying mechanism (2) for the exhaust valves (12) is actuated. Since, in this case, a certain torque constantly applied to the exhaust cam shaft functions to assist the needed movement of exhaust valve (12), the mechanism (2) exhibits a higher responsiveness in varying (or retarding) the close timing of exhaust valve (12) than the mechanism 1 in varying (or advancing) the open timing of intake valve 12.

Accordingly, upon need of the rapid shifting, the hydraulic pressure is instantly fed to the operation phase varying mechanism 2 to instantly and effectively actuate the mechanism 2. With this, advancing of the open timing of intake valve 12 and retarding of the close timing of exhaust valve (12) are instantly achieved at the same time.

That is, like in the case of the above-mentioned first embodiment, upon need of the rapid shifting, the control unit 3 (see FIGS. 4 and 6) operates to establish a condition wherein the practical sectional area of the first hydraulic line (see FIGS. 6 and 7) extending from oil pump 9 to advancing hydraulic chamber (64) of operation phase varying mechanism (2) for exhaust valves (12) is greater than the practical sectional area of second hydraulic line (see FIG. 4) extending from oil pump 9 to first or second hydraulic chamber 33 or 34 of working angle varying mechanism 1 for intake valves 12.

More specifically, upon need of the rapid shifting, the duty ratio of the control signal fed from control unit 3 to solenoid valve 31 (see FIG. 4) and that of the control signal fed from control unit 3 to electromagnetic switch valve 75 (see FIG. 6) are so controlled as to established the above-mentioned condition.

Usually, in the middle-load operation range, the working angle of intake valve 12 is set smaller than that of exhaust valve (12). Thus, under shifting from the middle-load operation range to the very low-load operation range, the hydraulic power needed by operation phase varying mechanism 2 is controlled relatively small, so that the reduction of the minus valve overlap is effectively made.

Figure 12A:
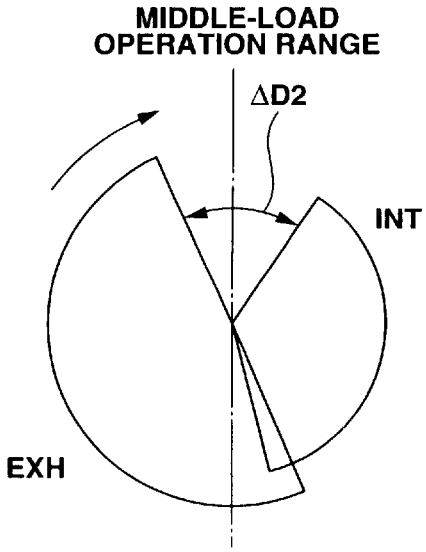
FIGS. 12A and 12B are illustrations similar to FIGS. 10A and 10B, but showing the conditions of the engine, which are achieved by a third embodiment of the present invention.
Figure 12B:
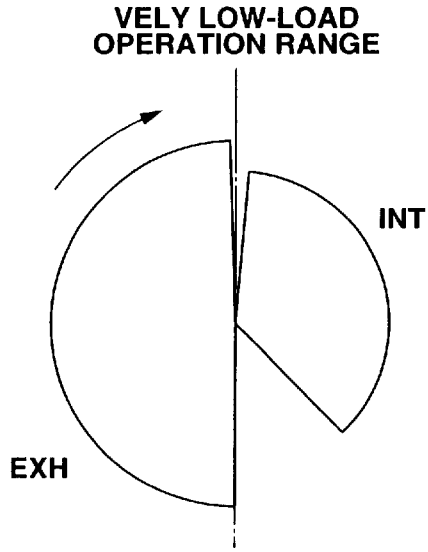

FIGS. 12A and 12B are illustrations schematically showing open/close timing of the intake and exhaust valves 12 and (12), which is provided by a third embodiment of the present invention.

In this third embodiment, controlling of intake valves 12 is carried out by allowing control unit 3 to control operation phase varying mechanism 2 for intake valves 12, and controlling of exhaust valves (12) is carried out by allowing control unit 3 to control both working angle and operation phase varying mechanisms (1) and (2) for exhaust valves (12).

As is seen from FIG. 12A, in a middle-load operation range, the open timing of intake valve 12 is set after the top dead center (TDC) on the intake stroke and the close timing of exhaust valve (12) is set before the top dead center (TDC) on the intake stroke, so that in the vanity of the top dead center (TDC) on the intake stroke, there is produced a minus valve overlap of a degree "ΔD2". Thus, reduction of pumping loss and improvement in fuel consumption in such middle-load operation range are achieved.

Generally, in the middle-load operation range, the working angle of exhaust valve (12) is set relatively large in order to advance the open timing of exhaust valve (12) toward the bottom dead center (BDC).

Like in the above-mentioned second embodiment, upon need of shifting from the middle-loaded operation range to the very low-load operation range, the open timing of intake valve 12 is advanced toward the top dead center (TDC) on the intake stroke and at the same time the close timing of exhaust valve (12) is retarded toward the top dead center (TDC) on the intake stroke to speedily reduce or cancel the minus valve overlap.

For retarding the close timing of exhaust valve (12), there are two methods, one being a method executed by working angle varying mechanism (1), and the other being a method executed by operation phase varying mechanism (2). In the method by working angle varying mechanism (1), the working angle of exhaust valve (12) is increased and in the method by the other mechanism (2), the operation phase of exhaust valve (12) is retarded.

For the same reason as mentioned in the second embodiment, under an even energy, that is, under the even hydraulic pressure produced by oil pump 9, the operation phase varying mechanism (2) can exhibit a higher responsiveness in retarding the close timing of exhaust valve (12) than working angle varying mechanism (1). Accordingly, upon need of the rapid shifting from the middle-loaded operation range to the very low-load operation range, the operation phase varying mechanism 2 is actuated to advance the operation phase of intake valve 12 and at the same time the operation phase varying mechanism (2) is actuated to retard the operation phase of exhaust valve (12). Since the certain torque constantly applied to the exhaust cam shaft functions to assist the needed movement of exhaust valve (12), the mechanism (2) exhibits a higher responsiveness in varying (or retarding) the close timing of exhaust valve (12) than the mechanism 1 in varying (or advancing) the open timing of intake valve 12.

Accordingly, upon need of the rapid shifting, the hydraulic pressure is instantly fed to the operation phase varying mechanism 2 to instantly and effectively actuate the mechanism 2. With this, advancing of the open timing of intake valve 12 and retarding of the close timing of exhaust valve (12) are instantly achieved at the same time.

Like in the above-mentioned first and second embodiments, upon need of the rapid shifting, the control unit 3 (see FIGS. 4 and 6) operates to establish a condition wherein the practical sectional area of a first hydraulic line (see FIGS. 6 and 7) extending from oil pump 9 to advancing hydraulic chamber 64 of operation phase varying mechanism 2 for intake valves 12 is greater than the practical sectional area of a second hydraulic line (see FIG. 4) extending from oil pump 9 to retarding hydraulic chamber (65) of operation phase varying mechanism (2) for exhaust valves (12).

More specifically, upon rapid shifting from the middle-load operation range to the very low-load operation range, that is, upon a rapid deceleration of the engine, the intake air is reduced due to reduction in engine speed, which induces retardation of the opening timing of exhaust valve (12) due to a so-called exhaust inertial effect. As is described hereinabove, in the third embodiment, for reducing or canceling the minus valve overlap, the operation phase of exhaust valve (12) is retarded by operation phase varying mechanism (2) and at the same time the open timing of the of exhaust valve (12) is retarded toward the bottom dead center (BDC). That is, in the third embodiment, upon the rapid shifting, there is no need of actuating working angle varying mechanism (1) for exhaust valves (12), and thus, energy is saved.

Figure 13A:
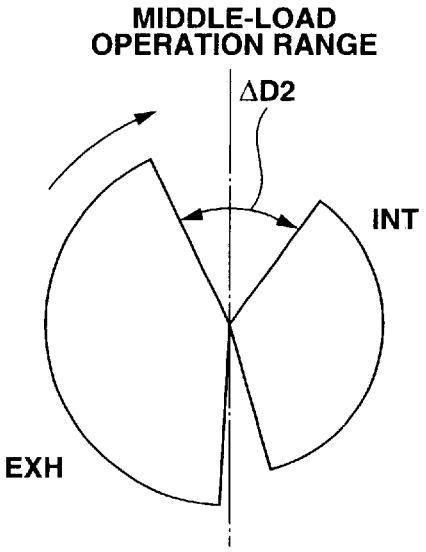
FIGS. 13A and 13B are illustrations similar to FIGS. 10A and 10B, but showing the conditions of the engine, which are achieved by a fourth embodiment of the present invention.
Figure 13B:
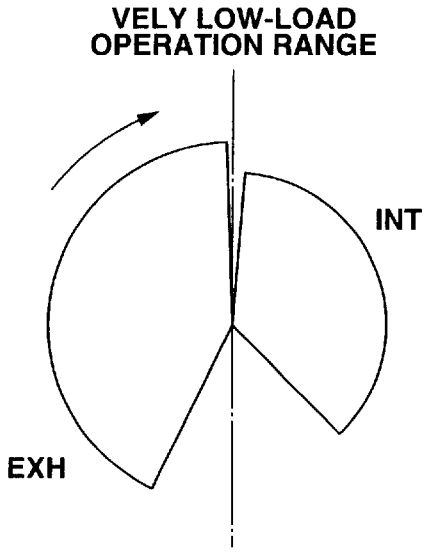

FIGS. 13A and 13B are illustrations schematically showing open/close timing of intake and exhaust valves 12 and (12), which is provided by a fourth embodiment of the present invention. The fourth embodiment is basically the same as the above-mentioned third embodiment except for the following.

That is, as is easily understood when comparing FIG. 13A and FIG. 12A, in the fourth embodiment, in the middle-load operation range, the working angle of exhaust valve (12) is set smaller than that in the case of the third embodiment and the open timing of exhaust valve (12) is set near or slightly after the bottom dead center (BDC).

Upon need of shifting from the middle-load operation range to the very low-load operation range due to rapid reduction of the engine speed, the operation phase of intake valve 12 is advanced by operation phase varying mechanism 2 for intake valves 12 and at the same time the operation phase of exhaust valve (12) is retarded by operation phase varying mechanism (2) for exhaust valves (12) without varying the working angle of exhaust valve (12) by the working angle varying mechanism (1) for exhaust valves (12). This is similar to the work in the third embodiment.

Thus, in the fourth embodiment, upon need of the rapid shifting from the middle-load operation range to the very low-load operation range, the minus valve overlap is effectively and speedily reduced or cancelled, like in the case of the third embodiment. Furthermore, since the open timing of exhaust valve (12) is retarded in compliance with retardation of the close timing of exhaust valve (12), a certain engine braking is effectively achieved upon reduction of the engine speed.

The entire contents of Japanese Patent Application 2000-262109 (filed Aug. 31, 2000) are incorporated herein by reference.

Although the invention has been described above with reference to the embodiments of the invention, the invention is not limited to such embodiments as described above. Various modifications and variations of such embodiments may be carried out by those skilled in the art, in light of the above descriptions.

What is claimed is:

1. A variable valve control device of an internal combustion engine having intake and exhaust valves, comprising:

an IVWAV mechanism which varies a working angle of the intake valve;

an IVOPV mechanism which varies an operation phase of the intake valve;

an EVOPV mechanism which varies an operation phase of the exhaust valve; and a control unit which controls said IVWAV, IVOPV and EVOPV mechanisms in accordance with an operation condition of the engine, said control unit being configured to carry out;

controlling, in a middle-load operation range of the engine, said IVWAV, IVOPV and EVOPV mechanisms to achieve a valve overlap wherein near the top dead center (TDC) on the intake stroke, there is a certain period when both the intake and exhaust valves assume their open conditions, and in case of shifting of the engine from the middle-load operation range to a very low-load operation range, controlling said IVWAV mechanism to reduce the working angle of said intake valve thereby to retard the open timing of said intake valve and controlling said EVOPV mechanism to advance the operation phase of said exhaust valve thereby to advance the close timing of said exhaust valve.

2. A variable valve control device as claimed in claim 1, in which said IVWAV, IVOPV and EVOPV mechanisms are powered by a common hydraulic source, and in which said control unit being configured to carry out:

upon shifting from said middle-load operation range to the very low-load operation range, controlling said IVWAV, IVOPV and EVOPV mechanisms in such a manner that the hydraulic pressure fed to said EVOPV mechanism exhibits a higher value than that fed to said IVWAV and IVOPV mechanisms.

3. A variable valve control device of an internal combustion engine having intake and exhaust valves, comprising:

an IVWAV mechanism which varies a working angle of the intake valve;

an IVOPV mechanism which varies an operation phase of the intake valve;

an EVOPV mechanism which varies an operation phase of the exhaust valve; and a control unit which controls said IVWAV, IVOPV and EVOPV mechanisms in accordance with an operation condition of the engine, said control unit being configured to carry out;

controlling, in a middle-load operation range of the engine, said IVWAV, IVOPV and EVOPV mechanisms to achieve a minus valve overlap wherein near the top dead center on the intake stroke, there is a certain period when both the intake and exhaust valves assume their close conditions;

and in case of shifting of the engine from the middle-load operation range to a very low-load operation range, controlling said IVOPV mechanism to advance the Operation phase of said intake valve thereby to advance the open timing of said intake valve and controlling said EVOPV mechanism to retard the operation phase of said exhaust valve thereby to retard the close timing of said exhaust valve.

4. A variable valve control device as claimed in claim 3, in which said IVWAV, IVOPV and EVOPV mechanisms are powered by a common hydraulic source, and in which said control unit being configured to carry out:

upon shifting from the middle-load operation range to the very low-load operation range, controlling said IVWAV, IVOPV and EVOPV mechanisms in such a manner that the hydraulic pressure fed to said IVOPV mechanism exhibits a higher value than that fed to said IVWAV and EVOPV mechanisms.

5. A variable valve control device as claimed in claim 3, in which said control unit is configured to carry out:

under the middle-load operation range, controlling said IVWAV and IVOPV mechanisms in such a manner that the working angle of the intake valve is smaller than that of said exhaust valve.

6. A variable valve control device of an internal combustion engine having intake and exhaust valves, comprising;

an IVOPV mechanism which varies an operation phase of the intake valve;

an EVWAV mechanism which varies a working angle of the exhaust valve;

an EVOPV mechanism which varies an operation phase of the exhaust valve;

a control unit which controls said IVOPV, EVWAV and EVOPV mechanisms in accordance with an operation condition of the engine, said control unit being configured to carry out;

controlling, in a middle-load operation range of the engine, said IVOPV, EVWAV and EVOPV mechanisms to achieve a minus valve overlap wherein near the top dead center on the intake stroke, there is a certain period when both the intake and exhaust valves assume their close conditions;

and in case of shifting of the engine from the middle-load operation range to a very low-load operation range, controlling said IVOPV mechanism to advance the operation phase of said intake valve thereby to advance the open timing of said intake valve and controlling said EVOPV mechanism to retard the operation phase of said exhaust valve thereby to retard the close timing of said exhaust valve.

7. A variable valve control device as claimed in claim 6, in which said control unit is configured to carry out:

under the middle-load operation range, controlling said EVWAV and EVOPV mechanisms in such a manner that the open timing of the exhaust valve is set at a point just before the bottom dead center (BDC), and upon shifting from the middle-load operation range to the very low-load operation range, controlling said EVOPV mechanism to retard the operation phase of the exhaust valve thereby to retard the open timing of the exhaust valve toward the bottom dead center (BDC).

8. A variable valve control device as claimed in claim 6, in which said control unit is configured to carry out:

under the middle-load operation range, controlling said EVWAV and EVOPV mechanisms in such a manner that the open timing of the exhaust valve is set at a point near the bottom dead center (BDC), and upon shifting from the middle-loaded operation range to the very low-load operation range, controlling said EVOPV mechanism to retard the operation phase of the exhaust valve thereby to retard the open timing of the exhaust valve away from the bottom dead center (BDC).

9. A variable valve control device of an internal combustion engine having intake and exhaust valves, comprising:

at least one of IVWAV and EVWAV mechanisms, said IVWAV mechanism functioning to vary a working angle of the intake valve and said EVWAV mechanism functioning to vary a working angle of the exhaust valve;

an IVOPV mechanism which varies an operation phase of the intake valve;

an EVOPV mechanism which varies an operation phase of the exhaust valve; and a control unit which controls the selected one of the IVWAV and EVWAV mechanisms and said IVOPV and EVOPV mechanisms in accordance with an operation condition of the engine, said control unit being configured to carry out;

controlling, in a middle-loaded operation range of the engine, the selected one of the IVWAV and EVWAV mechanisms and said IVOPV and EVOPV mechanisms to achieve a valve overlap or a minus valve overlap near the top dead center (TDC) on the intake stroke, and in case of shifting of the engine from the middle-load operation range to a very low-load operation range, controlling said IVWAV mechanism or said IVOPV mechanism to shift the open timing of said intake valve toward the top dead center (TDC) on the intake stroke, and controlling said EVWAV mechanism or EVOPV mechanism to shift the close timing of the exhaust valve toward the top dead center (TDC) on the intake stroke.

10. A variable valve control device as claimed in claim 9, in which each of said IVWAV and EVWAV mechanisms comprises:

a drive shaft rotated together with a crankshaft of the engine;

a swing cam pivotally disposed around said drive shaft, said swing cam opening and closing said intake or exhaust valve when swung;

an eccentric cam eccentrically fixed to said drive shaft to rotate therewith;

a first link rotatably disposed on said eccentric cam;

a control shaft extending in parallel with said drive shaft;

a control cam eccentrically fixed to said control shaft to rotate therewith;

a rocker arm rotatably disposed on said control cam and having one end pivotally connected to one end of said first link; and a second link having one end pivotally connected to the other end of said rocker arm and the other end pivotally connected to said swing cam.

11. A variable valve control device as claimed in claim 9, in which each of said IVOPV and EVOPV mechanisms comprises:

a cylindrical hollow member having front and rear covers hermetically secured to front and rear ends of the hollow member, said cylindrical hollow member being adapted to be rotated by the engine crankshaft;

a plurality of partition ridges formed on an inner cylindrical surface of said cylindrical hollow member at equally spaced intervals, so that identical spaces are each defined between adjacent two of the partition ridges;

a vane unit having a plurality of vane portions arranged at equally spaced intervals, said vane unit being rotatably disposed in said cylindrical hollow member so that each vane portion partitions the corresponding identical space into first and second hydraulic chambers, said vane unit being coaxially connected to a drive shaft to rotate therewith, said drive shaft being rotated together with the engine crankshaft;

a first hydraulic passage fluidly connectable to said first hydraulic chamber; and a second hydraulic passage fluidly connectable to said second hydraulic chamber.

12. In an internal combustion engine having intake and exhaust valves, an IVWAV mechanism which varies a working angle of the intake valve; an IVOPV mechanism which varies an operation phase of the intake valve; and an EVOPV mechanism which varies an operation phase of the exhaust valve, a method for controlling operation of the engine, comprising:

controlling, in a middle-load operation range of the engine, said IVWAV, IVOPV and EVOPV mechanisms to achieve a valve overlap wherein near the top dead center (TDC) on the intake stroke, there is a certain period when both the intake and exhaust valves assume their open conditions, and in case of shifting of the engine from the middle-load operation range to a very low-load operation range, controlling said IVWAV mechanism to reduce the working angle of said intake valve thereby to retard the open timing of said intake valve and controlling said EVOPV mechanism to advance the operation phase of said exhaust valve thereby to advance the close timing of said exhaust valve.

13. In an internal combustion engine having intake and exhaust valves, an IVWAV mechanism which varies a working angle of the intake valve; an IVOPV mechanism which varies an operation phase of the intake valve; and an EVOPV mechanism which varies an operation phase of the exhaust valve, a method of controlling the engine, comprising:

controlling, in a middle-load operation range of the engine, said IVWAV, IVOPV and EVOPV mechanisms to achieve a minus valve overlap wherein near the top dead center on the intake stroke, there is a certain period when both the intake and exhaust valves assume their close conditions;

and in case of shifting of the engine from the middle-load operation range to a very low-load operation range, controlling said IVOPV mechanism to advance the operation phase of said intake valve thereby to advance the open timing of said intake valve and controlling said EVOPV mechanism to retard the operation phase of said exhaust valve thereby to retard the close timing of said exhaust valve.

14. In an internal combustion engine having intake and exhaust valves, an IVOPV mechanism which varies an operation phase of the intake valve; an EVWAV mechanism which varies a working angle of the exhaust valve; and an EVOPV mechanism which varies an operation phase of the exhaust valve, a method of controlling the engine, comprising:

controlling, in a middle-load operation range of the engine, said IVWAV, IVOPV and EVOPV mechanisms to achieve a minus valve overlap wherein near the top dead center on the intake stroke, there is a certain period when both the intake and exhaust valves assume their close conditions;

and in case of shifting of the engine from the middle-load operation range to a very low-load operation range, controlling said IVOPV mechanism to advance the operation phase of said intake valve thereby to advance the open timing of said intake valve and controlling said EVOPV mechanism to retard the operation phase of said exhaust valve thereby to retard the close timing of said exhaust valve.

15. In an internal combustion engine having intake and exhaust valves, at least one of IVWAV and EVWAV mechanisms, said IVWA mechanism functioning to vary a working angle of the intake valve and said EVWAV mechanism functioning to vary a working angle of the exhaust valve; an IVOPV mechanism which varies an operation phase of the intake valve; and an EVOPV mechanism which varies an operation phase of the exhaust valve, a method of controlling the engine, comprising:

controlling, in a middle-loaded operation range of the engine, the selected one of the IVWAV and EVWAV mechanisms and said IVOPV and EVOPV mechanisms to achieve a valve overlap or a minus valve overlap near the top dead center (TDC) on the intake stroke, and in case of shifting of the engine from the middle-load operation range to a very low-load operation range, controlling said IVWAV mechanism or said IVOPV mechanism to shift the open timing of said intake valve toward the top dead center (TDC) on the intake stroke, and controlling said EVWAV mechanism or EVOPV mechanism to shift the close timing of the exhaust valve toward the top dead center (TDC) on the intake stroke.

* * * * *